US008994484B2

(12) United States Patent
Ando et al.

(10) Patent No.: US 8,994,484 B2
(45) Date of Patent: Mar. 31, 2015

(54) LINEAR SOLENOID

(71) Applicant: Denso Corporation, Kariya, Aichi-pref. (JP)

(72) Inventors: Motoyoshi Ando, Nagoya (JP); Thanh Do Nguyen, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 14/178,467

(22) Filed: Feb. 12, 2014

(65) Prior Publication Data

US 2014/0225693 A1 Aug. 14, 2014

(30) Foreign Application Priority Data

Feb. 14, 2013 (JP) ..... 2013-26178

(51) Int. Cl.

| | |
|---|---|
| ***H01F 3/12*** | (2006.01) |
| ***H01F 7/08*** | (2006.01) |
| ***H01F 7/16*** | (2006.01) |

(52) U.S. Cl.

CPC ..... *H01F 7/081* (2013.01); *H01F 7/1607* (2013.01)

USPC ..... 335/236; 335/281

(58) Field of Classification Search

USPC ..... 335/236, 281; 251/129.15

See application file for complete search history.

(56) References Cited

U.S. PATENT DOCUMENTS

| | | | |
|---|---|---|---|
| 2006/0243938 | A1 | 11/2006 | Ishibashi et al. |
| 2011/0128104 | A1 | 6/2011 | Yasoshima |

FOREIGN PATENT DOCUMENTS

| | | | |
|---|---|---|---|
| JP | 2009-180261 | A | 8/2009 |
| JP | 2011-119329 | A | 6/2011 |
| JP | 2011228568 | A * | 11/2011 |
| JP | 2012-241733 | A | 12/2012 |

OTHER PUBLICATIONS

Ando, et al., U.S. Appl. No. 14/178,474, filed Feb. 12, 2014.

Office Action issued in Japanese Patent Application No. 2013-26178 dated Jan. 6, 2015 (w/ partial translation).

* cited by examiner

*Primary Examiner* — Ramon Barrera

(74) *Attorney, Agent, or Firm* — Nixon & Vanderhye P.C.

(57) ABSTRACT

A stepped portion is formed in an outer peripheral portion of a slide core and is stepped to reduce an outer diameter of one portion of the slide core located on one axial side of the stepped portion. A first conducting portion of a ring core covers an outer peripheral surface of the one portion of the slide core and is slidable along an outer peripheral surface of the one portion of the slide core. The first conducting portion conducts a magnetic flux between the first conducting portion and the slide core in a radial direction. A second conducting portion of the ring core is configured into a form of a flange and radially outwardly extends from the first conducting portion. The second conducting portion conducts the magnetic flux between the second conducting portion and a bottom wall portion of a yoke in an axial direction.

3 Claims, 3 Drawing Sheets

LINEAR SOLENOID

CROSS REFERENCE TO RELATED APPLICATION

This application is based on and incorporates herein by reference Japanese Patent Application No. 2013-26178 filed on Feb. 14, 2013.

TECHNICAL FIELD

The present disclosure relates to a linear solenoid.

BACKGROUND

For example, JP4569371B2 (corresponding to US2006/0243938A1) recites a linear solenoid, which includes a plunger made of a magnetic material, a yoke made of a magnetic material and a stator core. The stator core includes a magnetically attracting core, a slide core and a magnetic shield portion, which are formed integrally.

In this linear solenoid, the plunger is placed on a radially inner side of a coil and is movable in an axial direction. The yoke is configured into a cup form and includes an opening, a bottom wall portion and a peripheral wall portion. The peripheral wall portion covers an outer peripheral portion of the coil, and the bottom wall portion covers one axial end of the coil.

The magnetically attracting core of the stator core is made of a magnetic material and magnetically attracts the plunger toward the other axial side, which is opposite from the one axial end of the coil, with a magnetic flux generated through energization of the coil. The slide core is made of the magnetic material and is configured into a tubular form. The slide core is placed on the radially inner side of the coil and covers an outer peripheral portion of the plunger. The slide core axially slidably supports the plunger and conducts the magnetic flux between the slide core and the plunger in a radial direction. The magnetic shield portion limits flow of the magnetic flux between the magnetically attracting core and the slide core.

The stator core is inserted into an inside of the yoke from one axial side of the stator core where the slide core is located, and the stator core is fixed to the yoke at the opening of the yoke. A distal end of the slide core is inserted into a hole formed in the bottom wall portion of the yoke such that a predetermined size of an installation gap is formed between the bottom wall portion of the yoke and the distal end of the slide core, so that the distal end of the slide core forms a free end that is not fixed to the yoke.

In the linear solenoid of JP4569371B2 (corresponding to US2006/0243938A1), a ring core is axially installed between the coil assembly and the bottom wall portion of the yoke to limit a reduction in the amount of the magnetic flux between the slide core and the yoke, caused by the presence of the installation gap. Here, the ring core is installed such that the ring core covers an outer peripheral portion of the slide core and is slidable relative to the slide core. Also, the ring core conducts the magnetic flux between the ring core and the slide core in the radial direction. The ring core contacts the bottom wall portion of the yoke and conducts the magnetic flux between the ring core and the bottom wall portion of the yoke in the axial direction.

However, due to the installation of the ring core, an axial size of the linear solenoid of JP4569371B2 (corresponding to US2006/0243938A1) is disadvantageously increased. Therefore, in order to meet a demand of increasing the number of winding turns of the coil and a demand of reducing the axial size without deteriorating the advantage of enhancing the conduction of the magnetic flux with the ring core, additional measures are required.

SUMMARY

The present disclosure is made in view of the above disadvantages. According to the present disclosure, there is provided a linear solenoid, which includes a coil, a plunger, a yoke, a stator core, a stepped portion, and a ring core. The plunger is made of a magnetic material. The plunger is placed on a radially inner side of the coil and is movable in an axial direction. The yoke is made of a magnetic material and is configured into a cup form. The yoke includes an opening and a bottom wall portion and covers an outer peripheral portion of the coil. The stator core includes a magnetically attracting core and a slide core. The magnetically attracting core is made of a magnetic material and magnetically attracts the plunger in the axial direction with a magnetic flux generated through energization of the coil. The slide core is made of a magnetic material and is configured into a tubular form. The slide core is placed on a radially inner side of the coil and covers an outer peripheral portion of the plunger. The slide core axially slidably supports the plunger and conducts the magnetic flux between the slide core and the plunger in a radial direction. The magnetically attracting core and the slide core are integrated with each other along with a magnetic shield portion, which is interposed between the magnetically attracting core and the slide core in the axial direction. The stator core is inserted into an inside of the yoke from one axial side of the stator core where the slide core is located. The stator core is fixed to the yoke at the opening. The stepped portion is formed in an outer peripheral portion of the slide core and is stepped to reduce an outer diameter of one portion of the slide core located on one axial side of the stepped portion, which is axially opposite from the magnetically attracting core, in comparison to another portion of the slide core located on another axial side of the stepped portion where the magnetically attracting core is placed. The ring core is made of a magnetic material and includes a first conducting portion and a second conducting portion. The first conducting portion covers an outer peripheral surface of the one portion of the slide core and is slidable along the outer peripheral surface of the one portion of the slide core. The first conducting portion conducts the magnetic flux between the first conducting portion and the slide core in the radial direction. The second conducting portion is configured into a form of a flange and radially outwardly extends from the first conducting portion. The second conducting portion conducts the magnetic flux between the second conducting portion and the bottom wall portion of the yoke in the axial direction.

BRIEF DESCRIPTION OF THE DRAWINGS

The drawings described herein are for illustration purposes only and are not intended to limit the scope of the present disclosure in any way.

DETAILED DESCRIPTION

An embodiment of the present disclosure will be described with reference to the accompanying drawings.

Figure 1:
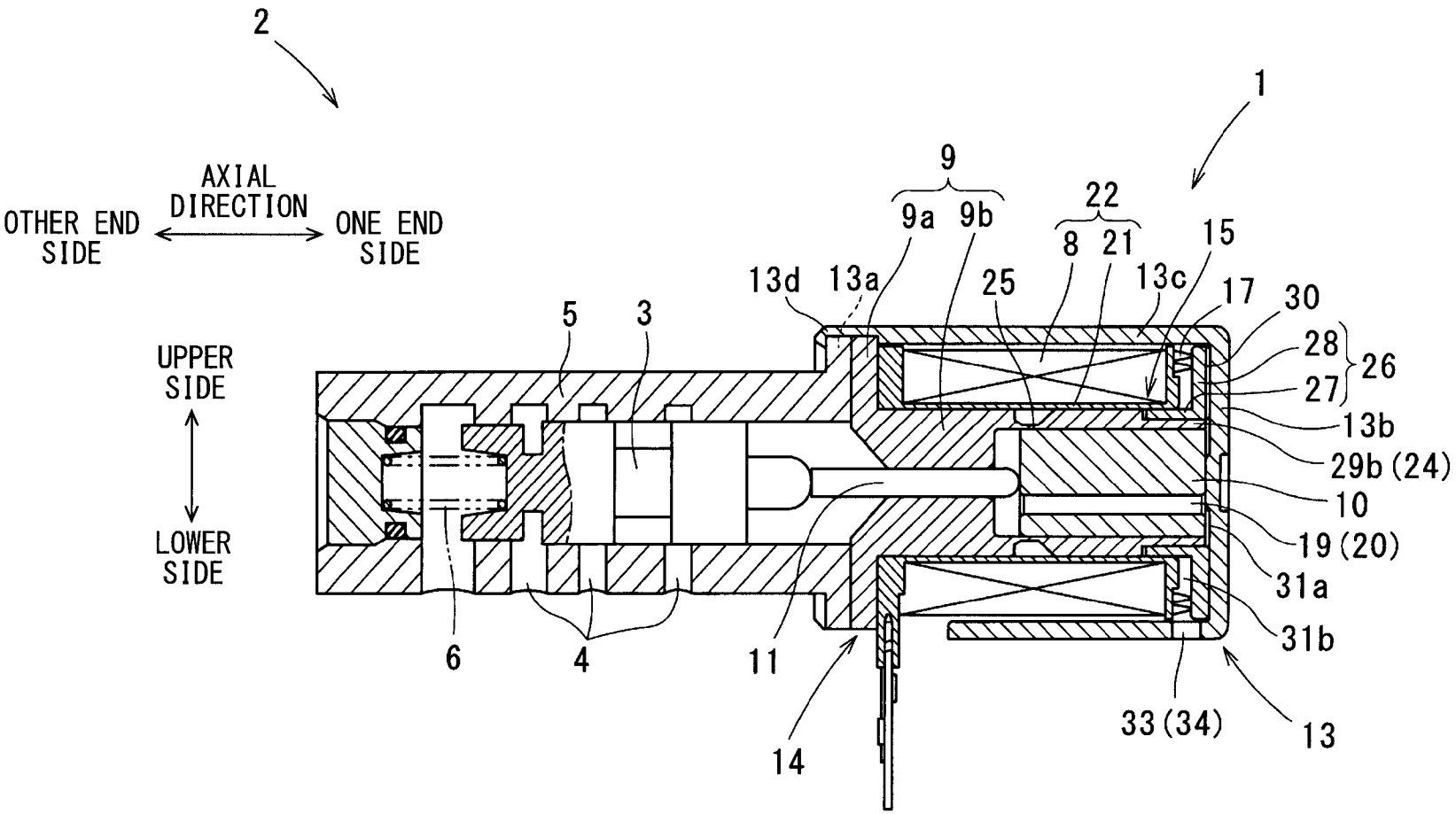
FIG. 1 is a longitudinal cross-sectional view of a hydraulic pressure control valve including a linear solenoid according to an embodiment of the present disclosure.
Figure 2A:
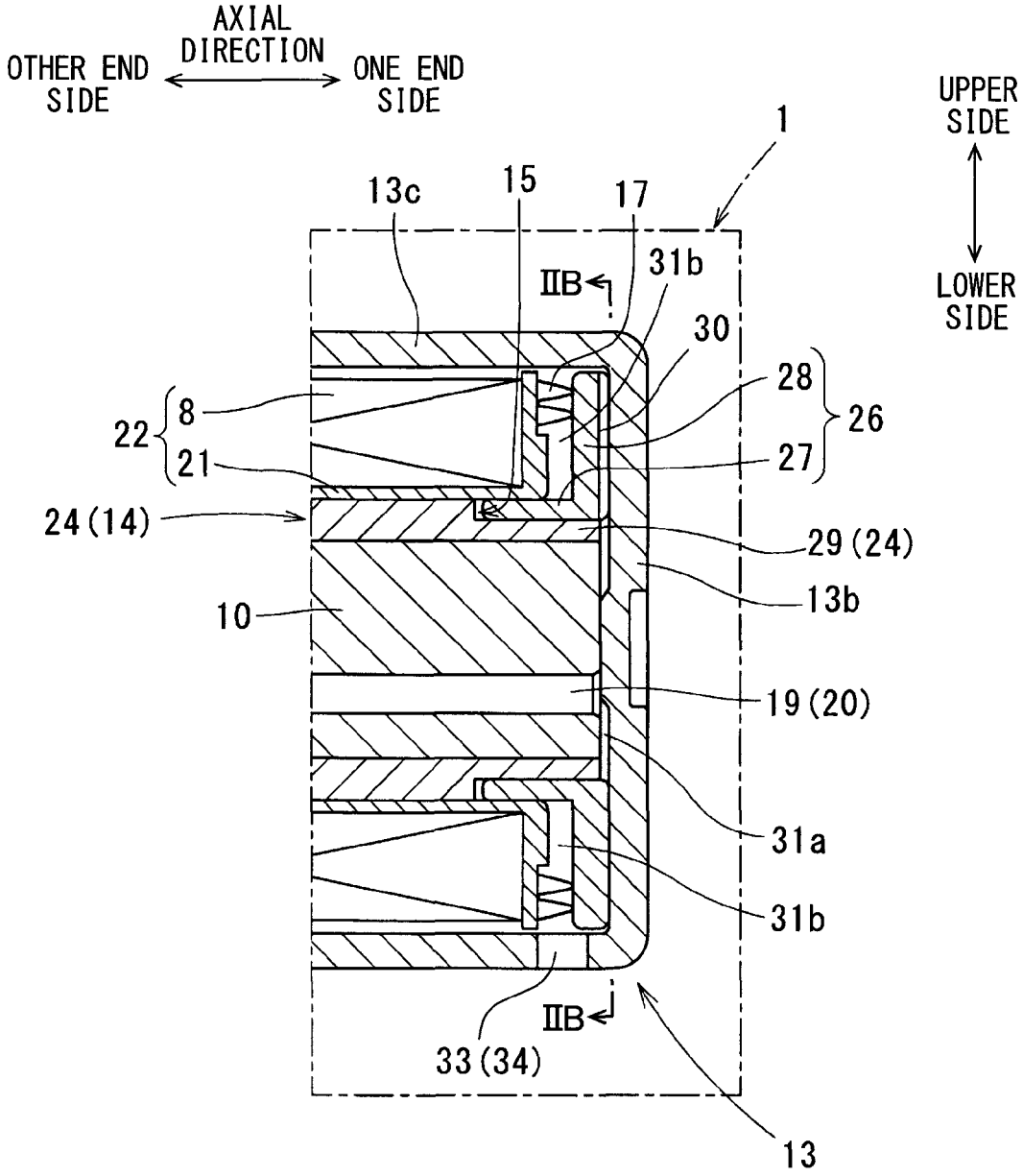
FIG. 2A is a partial enlarged longitudinal cross-sectional view showing a main feature of the linear solenoid according to the embodiment.

A structure of a linear solenoid 1 of the present embodiment will be described with reference to FIGS. 1 to 2B.

For example, the linear solenoid 1 is used as an actuator that generates an axial thrust force for driving a spool 3, which serves as a valve element of a hydraulic pressure control valve 2.

The hydraulic pressure control valve 2 controls a hydraulic pressure (also referred to as an oil pressure) of a control subject by supplying hydraulic oil to the control subject or draining the hydraulic oil from the control subject. The hydraulic pressure control valve 2 is installed in, for example, a hydraulic pressure control apparatus of an automatic transmission of a vehicle (e.g., an automobile) such that the hydraulic pressure control valve 2 is immersed in the hydraulic oil.

The spool 3 is axially slidably received in an inside of a sleeve 5, which is configured into a tubular form and has various ports 4. The linear solenoid 1 is integrally installed to one end side (also referred to as one axial end side or one axial side) of the spool 3 and the sleeve 5. A spring 6 is installed in the inside of the sleeve 5. The spring 6 urges the spool 3 in a direction that is opposite from a direction of the thrust force outputted from the linear solenoid 1. The spool 3 is driven to change a communication state between each corresponding ones of the ports 4 based on a balance of the thrust force outputted from the linear solenoid 1, the urging force of the spring 6 and a feedback force of the hydraulic pressure.

Now, the linear solenoid 1 will be described in detail.

The linear solenoid 1 generates the thrust force by magnetically attracting the plunger 10 to a magnetically attracting core 9 toward the other end side (also referred to as the other axial end side or the other axial side), which is opposite from the one end side, upon generation of a magnetic flux through energization of the coil 8. The generated thrust force is conducted to the spool 3 through a shaft 11.

The linear solenoid 1 includes the plunger 10, a yoke 13, a stator core 14, a stepped portion 15, a ring core 26 and an urging member (urging means) 17.

The plunger 10 is a magnetic metal body, which is made of a ferromagnetic material and is configured into a generally cylindrical form. The plunger 10 directly slidably contacts an inner peripheral surface of the stator core 14. The plunger 10 is axially movable at a location, which is on a radially inner side of the coil 8.

An end surface (the other end surface) of the plunger 10, which is located on the spool 3 side in the axial direction, contacts a distal end of the shaft 11. The plunger 10 is urged along with the spool 3 by the urging force of the spring 6 conducted to the spool 3 in the axial direction. A through-hole 19 extends through the plunger 10 in the axial direction. The through-hole 19 functions as a first breathing passage 20, through which fluid is moved between the one end side of the plunger 10 and the other end side of the plunger 10.

The coil 8 has a conductive wire (e.g., an enamel wire), which is covered with a dielectric cover and is wound multiple times around a bobbin 21 made of a resin material. The coil 8 and the bobbin 21 form a coil assembly 22.

The yoke 13 is made of a ferromagnetic material and is configured into a cup form. Specifically, the yoke 13 includes an opening 13*a*, a bottom wall portion 13*b* and a peripheral wall portion (also referred to as a lateral wall portion) 13*c*. The peripheral wall portion 13*c* is configured into a tubular form and covers an outer peripheral portion of the coil 8. The bottom wall portion 13*b* covers one axial end portion of the coil assembly 22 located on one axial side. The yoke 13 conducts a magnetic flux, which is generated through energization of the coil 8. A claw 13*d* is formed at the other axial end of the yoke 13, which forms the opening 13*a*. The claw 13*d* is plastically deformed against and is thereby secured to one axial end portion of the sleeve 5 after installation of the plunger 10, the stator core 14 and the coil assembly 22 into the inside of the yoke 13.

The stator core 14 is placed on the radially inner side of the coil assembly 22 and also on the other axial side of the coil assembly 22. The stator core 14 includes a magnetically attracting core 9, a magnetic shield portion 25 and a slide core 24, which are integrated together such that the magnetic shield portion 25 is interposed between the magnetically attracting core 9 and the slide core 24 in the axial direction.

The magnetically attracting core 9 is made of a ferromagnetic material. The magnetically attracting core 9 magnetically attracts the plunger 10 toward the other end side that is axially opposite from the one end side with the magnetic flux generated through energization of the coil 8. The magnetically attracting core 9 includes a flange portion 9*a* and an attracting portion 9*b*. The flange portion 9*a* is located on the other end side of the coil assembly 22 and is magnetically coupled with the opening end of the yoke 13. The attracting portion 9*b* is placed on the radially inner side of the coil assembly 22 and is axially opposed to the plunger 10. The attracting portion 9*b* axially slidably supports the shaft 11.

The slide core 24 is made of a ferromagnetic material and is configured into a cylindrical tubular form. The slide core 24 is connected to the one end of the magnetically attracting core 9 through the magnetic shield portion 25. The slide core 24 is placed on the radially inner side of the coil assembly 22 and covers the outer peripheral portion of the plunger 10 along the entire circumferential extent and the entire axial extent of the plunger 10. The slide core 24 axially slidably supports the plunger 10 and conducts the magnetic flux between the slide core 24 and the plunger 10 in the radial direction. One of an outer peripheral surface of the plunger 10 and an inner peripheral surface of the slide core 24 is surface treated to form a non-magnetic coating or layer thereon, so that stucking of the plunger 10 to the slide core 24 is limited.

The magnetic shield portion 25 limits direct flow of the magnetic flux between the magnetically attracting core 9 and the slide core 24 and is formed as a thin wall portion, which has a large magnetic resistance.

The stator core 14 is inserted into the inside of the yoke 13 from one axial side of the stator core 14 where the slide core 24 is located. The stator core 14 is fixed to the yoke 13 at the flange portion 9*a* through the plastic deformation of the claw 13*d* against the end portion of the sleeve 5.

The stepped portion 15, which is configured into a form of a step, is formed in an outer peripheral portion of the slide core 24. The stepped portion 15 is stepped to reduce an outer diameter of one portion of the slide core 24 located on one axial side of the stepped portion 15 in comparison to the other portion (another portion) of the slide core 24 located on the other axial side (another axial side) of the stepped portion 15. Specifically, the outer diameter of the one portion of the slide core 24 located on the one axial side of the stepped portion 15, which is axially opposite from the magnetically attracting core 9, is reduced in comparison to the other portion of the slide core 24 located on the other axial side of the stepped portion 15 where the magnetically attracting core 9 is placed.

The ring core 26 is made of a ferromagnetic material and is formed as a cylindrical body having a flange at one axial end of the cylindrical body. The ring core 26 has a first conducting portion 27 and a second conducting portion 28. The first conducting portion 27 covers the outer peripheral part of the one portion (hereinafter referred to as a reduced diameter portion 29) of the slide core 24 located on the one axial side of the stepped portion 15. Furthermore, the first conducting portion 27 is slidable relative to the reduced diameter portion 29. The first conducting portion 27 conducts the magnetic flux between the first conducting portion 27 and the slide core 24 in the radial direction. The second conducting portion 28 is the flange, which is configured into a ring plate form and radially outwardly projects from the first conducting portion 27. The second conducting portion 28 contacts the bottom wall portion 13*b* and conducts the magnetic flux between the second conducting portion 28 and the bottom wall portion 13*b* in the axial direction.

Figure 2B:
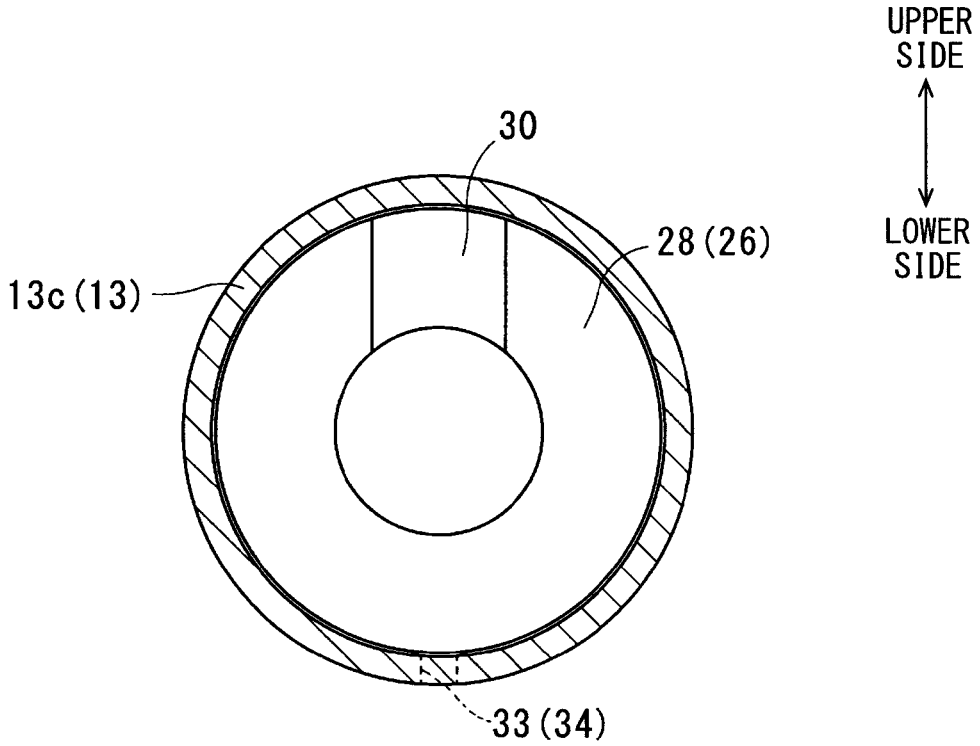
FIG. 2B is a transverse cross-sectional view of the linear solenoid taken along line IIB-IIB in FIG. 2A according to the embodiment, showing a cross section of a peripheral wall portion of a yoke and a bottom surface of a ring core while eliminating a plunger and a slide core for the sake of simplicity.

A groove 30 is formed in one end surface of the second conducting portion 28 and radially extends in the direction, which is from the central axis of the linear solenoid 1 to the upper side immediately above the central axis of the linear solenoid 1 in FIG. 2B. The groove 30 communicates between a space 31*a* and a space 31*b*. The space 31*a* is formed on the one end side of the plunder 10 and is defined by the reduced diameter portion 29, the first conducting portion 27 and the bottom wall portion 13*b*. Furthermore, the space 31*b* is defined between the coil assembly 22 and the second conducting portion 28 in the axial direction.

A communication hole 33 is formed in the peripheral wall portion 13*c* and communicates between the inside and an outside of the yoke 13 in the radial direction. The communication hole 33 extends through the peripheral wall portion 13*c* in the radial direction, which is from the central axis of the linear solenoid 1 to the lower side immediately below the central axis of the linear solenoid 1 in FIG. 2B. The communication hole 33 overlaps with the space (also referred to as a gap) 31*b* in the axial direction. In other words, an axial extent of the communication hole 33 overlaps with an axial extent of the space 31*b*. In this way, the communication hole 33 functions as a second breathing passage 34, which communicates the space 31*a*, the space 31*b* and a space formed around one axial end portion of the plunger 10 to the outside of the yoke 13 to enable flow of fluid therebetween.

The first breathing passage 20 is configured to conduct the fluid between the one end side and the other end side of the plunger 10, and the second breathing passage 34 is configured to conduct the fluid between the inside and the outside of the yoke 13 in the radial direction. Therefore, the first breathing passage 20 and the second breathing passage 34 enable the smooth movement of the plunger 10 in the axial direction in response to the starting and stopping of the energization of the coil 8.

The urging member 17 urges the second conducting portion 28 against the bottom wall portion 13*b*. The urging member 17 may be, for example, a rubber, a Belleville spring or a wave washer.

Now, advantages of the present embodiment will be described.

The linear solenoid 1 of the embodiment includes the stepped portion 15 and the ring core 26.

The stepped portion 15 is formed in the outer peripheral portion of the slide core 24. The stepped portion 15 is stepped to reduce the outer diameter of the one portion of the slide core 24 located on the one axial side of the stepped portion 15 to form the reduced diameter portion 29. The ring core 26 includes the first conducting portion 27, which is configured into the cylindrical tubular form, and the second conducting portion 28, which is configured into the form of the flange. The first conducting portion 27 covers the outer peripheral part of the reduced diameter portion 29 of the slide core 24 located on the one axial side of the stepped portion 15. Furthermore, the first conducting portion 27 is slidable relative to the reduced diameter portion 29. The first conducting portion 27 conducts the magnetic flux between the first conducting portion 27 and the slide core 24 in the radial direction. The second conducting portion 28 contacts the bottom wall portion 13*b* and conducts the magnetic flux between the second conducting portion 28 and the bottom wall portion 13*b* in the axial direction.

In this way, an additional space can be provided on the radially outer side of the first conducting portion 27 and on the other end side of the second conducting portion 28. Thereby, when the coil assembly 22 is placed in this space, it is possible to meet the demand for increasing the number of winding turns of the coil 8 and the demand for reducing the radial size of the coil 8 without sacrificing the advantage of enhancing the conduction of the magnetic flux with the ring core 26.

Furthermore, the linear solenoid 1 includes the urging member 17, which urges the second conducting portion 28 against the bottom wall portion 13*b*. The urging member 17 enhances the conduction of the magnetic flux between the yoke 13 and the ring core 26.

Now, modifications of the above embodiment will be described.

In the hydraulic pressure control valve 2, which has the linear solenoid 1 of the above embodiment, the spool 3 is configured to change the communication state between each corresponding ones of the ports 4 based on the balance of the thrust force outputted from the linear solenoid 1, the urging force of the spring 6 and the feedback force of the hydraulic pressure (oil pressure). Alternatively, the linear solenoid of the present disclosure may be applied to a hydraulic pressure control valve, in which the feedback force of the hydraulic pressure is not applied to the spool.

Furthermore, the linear solenoid 1 of the above embodiment is formed as the component of the hydraulic pressure control valve 2. Alternatively, the linear solenoid 1 may be used as a component of any other suitable devices, which are other than the hydraulic pressure control valve 2.

What is claimed is:

1. A linear solenoid comprising:

a coil;

a plunger that is made of a magnetic material, wherein the plunger is placed on a radially inner side of the coil and is movable in an axial direction;

a yoke that is made of a magnetic material and is configured into a cup form, wherein the yoke includes an opening and a bottom wall portion and covers an outer peripheral portion of the coil;

a stator core that includes:

a magnetically attracting core, which is made of a magnetic material and magnetically attracts the plunger in the axial direction with a magnetic flux generated through energization of the coil; and a slide core, which is made of a magnetic material and is configured into a tubular form, wherein the slide core is placed on a radially inner side of the coil and covers an outer peripheral portion of the plunger, and the slide core axially slidably supports the plunger and conducts the magnetic flux between the slide core and the plunger in a radial direction, wherein:

the magnetically attracting core and the slide core are integrated with each other along with a magnetic shield portion, which is interposed between the magnetically attracting core and the slide core in the axial direction; and the stator core is inserted into an inside of the yoke from one axial side of the stator core where the slide core is located, and the stator core is fixed to the yoke at the opening;

a stepped portion that is formed in an outer peripheral portion of the slide core and is stepped to reduce an outer diameter of one portion of the slide core located on one axial side of the stepped portion, which is axially opposite from the magnetically attracting core, in comparison to another portion of the slide core located on another axial side of the stepped portion where the magnetically attracting core is placed; and a ring core that is made of a magnetic material and includes:

a first conducting portion, which covers an outer peripheral surface of the one portion of the slide core and is slidable along the outer peripheral surface of the one portion of the slide core, wherein the first conducting portion conducts the magnetic flux between the first conducting portion and the slide core in the radial direction; and a second conducting portion, which is configured into a form of a flange and radially outwardly extends from the first conducting portion, wherein:

the second conducting portion conducts the magnetic flux between the second conducting portion and the bottom wall portion of the yoke in the axial direction;

an outer diameter of the first conducting portion of the ring core is smaller than an inner diameter of the coil; and an axial extent of the coil overlaps with an axial extent of the first conducting portion of the ring core to place a portion of the coil on a radially outer side of the first conducting portion of the ring core.

2. The linear solenoid according to claim 1, comprising an urging member that urges the second conducting portion against the bottom wall portion of the yoke.

3. The linear solenoid according to claim 1, wherein:

the outer diameter of the first conducting portion of the ring core is equal to an outer diameter of the another portion of the slide core;

the coil is wound around a bobbin, which has an inner peripheral surface that continuously extends in parallel with the axial direction and has a constant inner diameter along an entire extent of the inner peripheral surface of the bobbin; and the inner peripheral surface of the bobbin radially contacts an outer peripheral surface of the first conducting portion of the ring core and an outer peripheral surface of the another portion of the slide core.

* * * * *